US011433516B2

(12) United States Patent
Quicke

(10) Patent No.: US 11,433,516 B2
(45) Date of Patent: Sep. 6, 2022

(54) FASTENER HOLDING SPANNER

(71) Applicant: Enerpac UK Ltd, Northumberland (GB)

(72) Inventor: Stephen Quicke, Northumberland (GB)

(73) Assignee: Enerpac UK Ltd, Northumberland (GB)

( * ) Notice: Subject to any disclaimer, the term of this patent is extended or adjusted under 35 U.S.C. 154(b) by 475 days.

(21) Appl. No.: 16/336,718

(22) PCT Filed: Sep. 26, 2017

(86) PCT No.: PCT/GB2017/052871

§ 371 (c)(1),
(2) Date: Mar. 26, 2019

(87) PCT Pub. No.: WO2018/055417

PCT Pub. Date: Mar. 29, 2018

(65) Prior Publication Data

US 2021/0291331 A1 Sep. 23, 2021

(30) Foreign Application Priority Data

Sep. 26, 2016 (GB) ..... 1616295

(51) Int. Cl.
*B25B 23/00* (2006.01)
*B25B 13/04* (2006.01)
*B25B 27/16* (2006.01)

(52) U.S. Cl.
CPC ..... *B25B 23/0085* (2013.01); *B25B 13/04* (2013.01); *B25B 27/16* (2013.01)

(58) Field of Classification Search
CPC ..... B25B 23/00; B25B 13/48; B25B 23/10; B25B 9/00; B25B 23/0085; B25B 13/04; B25B 27/16
See application file for complete search history.

(56) References Cited

U.S. PATENT DOCUMENTS 4,570,513 A 2/1986 Martin
4,787,275 A * 11/1988 Colvin ..... B25B 13/12 81/155

(Continued)

FOREIGN PATENT DOCUMENTS

CN 2106 041 12/1990
CN 105252468 A 1/2016

(Continued)

OTHER PUBLICATIONS

International Search Report with Written Opinion for related Application No. PCT/GB2018/051513 dated Sep. 17, 2018 (8 Pages).

(Continued)

*Primary Examiner* — Robert J Scruggs
(74) *Attorney, Agent, or Firm* — Michael Best & Friedrich LLP

(57) ABSTRACT

A fastener holding spanner comprises a spanner head defining an aperture capable of engaging during use with a correspondingly-sized nut or bolt head of a fastener, with a clearance there-between, and at least one arm extending from the spanner head. During use of the spanner one of the at least one arms is capable of engaging with an abutment surface adjacent to a nut or bolt head of a fastener engaged by the spanner head upon rotation of the nut or bolt head under applied torque. The aperture comprises a plurality of internal faces, at least two of which are engaging faces. The engaging faces are substantially flat and are arranged to engage with flat faces of a nut or bolt head engaged by the spanner during use. At least one of the internal faces of the aperture is non-engaging with the nut or bolt head during use, the at least one non-engaging face located in between the at least two engaging faces. The aperture further comprises at least one through passage penetrating at least one of the internal faces, the at least one through passage having a longitudinal axis and being at least partially threaded over (Continued)

at least part of its length. In use a threaded member having a flat end may be screwed into the at least one passage, the flat end of the threaded member to contact under pressure a face of a nut or bolt head engaged by the spanner to prevent relative rotation between the spanner and the nut or bolt head. At least two engaging faces of the aperture are distal from the threaded member and located on opposing sides of the longitudinal axis of the at least one through passage.

15 Claims, 8 Drawing Sheets

(56) References Cited

U.S. PATENT DOCUMENTS 4,869,633 A * 9/1989 Hayashi ..... B25B 13/065 411/368
5,415,064 A * 5/1995 Chang ..... B25B 13/12 81/166
7,418,890 B2 * 9/2008 Buchanan ..... B25B 13/04 81/124.4
9,718,170 B2 * 8/2017 Eggert ..... B25B 13/065

FOREIGN PATENT DOCUMENTS

| | | |
|---|---|---|
| DE | 1 024 511 | 4/2004 |
| GB | 2478955 | 9/2011 |
| WO | WO 2011/100256 | 8/2011 |

OTHER PUBLICATIONS

Examination Report issued from the European Patent Office for related Application No. 17794398.2 dated Feb. 12, 2021 (4 Pages).
Office Action issued from the European Patent Office for related Application No. 17 794 398.2 dated Sep. 30, 2021 (6 Pages).

* cited by examiner

FASTENER HOLDING SPANNER

FIELD OF THE INVENTION

The present invention relates to a fastener holding spanner.

BACKGROUND OF THE INVENTION

Fasteners in the form of polygonally-shaped nuts, threaded studs (both continuously-threaded and partially-threaded) and bolts having polygonally-shaped heads are used in many industries for many applications to hold components together. The polygonally-shaped nuts and bolt heads are typically hexagonally shaped, although other polygonal shapes, e.g. square, may be used.

In assembling or disassembling components held together by nuts and studs or bolts, it is usually necessary to restrain one of the nut or bolt from rotation whilst the other is rotated to tighten or loosen it. One option for restraining a nut or bolt is to provide a complementarily-shaped opening in one component into which the nut or bolt head fits and is held against rotation when torque is applied to the other nut or bolt. Alternatively, a pair of spanners (wrenches) or spanner and socket combination or the like may be used to hold one nut or bolt stationary whilst the other nut has torque applied to it. As will be appreciated, the pair of spanners or the like may each be rotated to apply torque in opposite senses to one another. As is well understood, spanners have complementary-shaped polygonal apertures or multi-point apertures into which a nut or bolt head may be located.

In applications in which small and relatively small fasteners are used to hold components together, the assembly and disassembly of components to be held or held by the fasteners is relatively simple and the levels of torque applied to the fasteners is limited as it is relatively easy to shear the stud or bolt used or to damage the nut if too much torque is applied or to damage the components being secured together.

However, in applications in which larger fasteners are used, such as in flanged connections in pipelines, flanged closures for pressure vessels etc., the levels of torque required to achieve the necessary joint tightness during assembly may be very high. The disassembly of such joints may require even higher torque to overcome corrosion etc. caused by bad weather and chemicals, especially in applications in chemical plants, oilfields and refineries. Such problems may be exacerbated if the bolt or stud was preheated prior to the application of nut(s) thereto to create a compression joint. Additionally, in such applications, to add to the difficulties of assembly or disassembly of such joints, access to one side or other of the joint may be limited.

In many such applications, the assembly or disassembly of such components has been a two-person job: one person using an appropriate torque tool, eg a manually-applied spanner but more usually a fluid-operated (normally hydraulic) torque wrench, and the other a manually-applied spanner to restrain the other nut or bolt head from rotating. However, owing to the levels of the torque applied, it may be beyond the physical ability of the other person to prevent rotation or may be dangerous to do so, especially when access may be limited. In such circumstances, the handle of the spanner is allowed to contact an abutment surface, frequently an adjacent nut or bolt head but not necessarily always so, to prevent rotation of it by the torque applied to the bolt head or other nut, the person merely being present to ensure proper engagement of the spanner with the nut or bolt head until such engagement with the abutment surface occurs.

Although such assembly and disassembly of these types of joints has been performed in this manner for many years, a problem which occurs is that, owing to a slight rotation of the nut or bolt head of the fastener within the polygonally-shaped opening of the manually-applied spanner under the applied torque, the spanner and the nut or bolt head bind together in a significant frictional relationship with one another which is very difficult to break to enable release of the spanner for removal. Frequently, it is necessary to resort to force, e.g. by hitting the spanner handle with a hammer, to effect release of the spanner.

GB2478955 proposed a solution to this problem by providing a fastener holding spanner which includes a hexagonal shaped aperture which is a close fit over the bolt and is secured to the bolt using a grub screw. As shown in FIG. 1, the aperture of the spanner 1 is slightly larger than the bolt 4 to allow for easy fitting of the spanner 1 onto the bolt 4. The passage through which the grub screw 5 passes is inclined at a slight angle 2 to the perpendicular 3 of the face 7 of the aperture which it penetrates. When the grub screw 5 is tightened the bolt 4 rotates slightly within the aperture and the fastener 4 contacts the faces of the aperture at six different loading points 6 as shown in FIG. 1. The spanner 1 attaches firmly to the bolt 4 and by abutting and adjacent bolt head it prevents the bolt 4 from rotating whilst torque is applied to the corresponding nut. As torque is applied to the nut the load is distributed over these six discrete loading points 6. In addition, the spanner described in GB3478955 must be machined rather than cast to form the hexagonal aperture, and this increases manufacturing costs. It would be desirable to provide an improved fastener holding spanner.

SUMMARY OF THE INVENTION

According to the present invention there is provided a fastener holding spanner comprising a spanner head defining an aperture capable of engaging during use with a correspondingly-sized nut or bolt head of a fastener, with a clearance there-between, and at least one arm extending from the spanner head, one of the at least one arms during use of the spanner being capable of engaging with an abutment surface adjacent to a nut or bolt head of a fastener engaged by the spanner head upon rotation of the nut or bolt head under applied torque, wherein the aperture comprises a plurality of internal faces, at least two of which are engaging faces, the engaging faces being substantially flat and arranged to engage with flat faces of a nut or bolt head engaged by the spanner during use, wherein at least one of the internal faces of the aperture is non-engaging with the nut or bolt head during use, the at least one non-engaging face located in between the at least two engaging faces, the aperture further comprising at least one through passage penetrating at least one of the internal faces, the at least one through passage having a longitudinal axis and being at least partially threaded over at least part of its length whereby, in use, a threaded member having a flat end may be screwed into the at least one passage, the flat end of the threaded member to contact under pressure a face of a nut or bolt head engaged by the spanner to prevent relative rotation between the spanner and the nut or bolt head, wherein the at least two engaging faces of the aperture are distal from the threaded member and located on opposing sides of the longitudinal axis of the at least one through passage.

Preferably, the at least one non-engaging face of the aperture is concave.

Preferably, the longitudinal axis of the through passage is oriented substantially perpendicular to the inner face of the aperture which it penetrates.

Preferably, the aperture comprises an even number of internal faces and half of the internal faces are substantially flat and half of the internal faces are concave, each concave internal face being located in-between two flat internal faces. In a preferred embodiment, the aperture has six internal faces, three of which are substantially flat and three of which are concave. Such an aperture corresponds to a hexagonal nut or bolt head.

Preferably, the or each through passage penetrates a substantially flat internal face.

Preferably, the aperture and the at least one arm lie in a common plane.

Preferably, the spanner comprises one arm and the arm of the spanner comprises a second spanner head integral with and having the same features as the first spanner head. In a preferred embodiment, the longitudinal axis of a through passage of the second spanner head may be spaced apart from and parallel to the longitudinal axis of a through passage of the first spanner head. Alternatively, the through passages may be located on the same side of the spanner. The apertures in the two spanner heads may be the same size or, alternatively, in a preferred embodiment the apertures in the two spanner heads may be different sizes.

Alternatively, the spanner may comprise two arms and the arms of the spanner comprise two additional spanner heads integral with and having the same features as the first spanner head. The apertures in the three spanner heads may be the same size or, alternatively, in a preferred embodiment the apertures in the three spanner heads may be different sizes.

The threaded member or members used with the spanner to engage with a nut or bolt head may be a bolt but is more preferably a grub (set) screw typically of hardened steel. The end of the member which contacts the face of the nut or bolt head may be flat but may be of a rounded shape, i.e. domed or cup pointed. When the member is a grub screw, the opposite, non-engagement end may be provided with a slot, hexagonal or square aperture or protrusion etc. to drive the grub screw as is well understood in the art.

The invention includes a set of spanners comprising at least two spanners according to the invention as herein described, the apertures of the spanner heads being selected to provide a range of sizes suitable for use with common nut and bolt head sizes.

BRIEF DESCRIPTION OF THE DRAWINGS

In the drawings, which illustrate a preferred embodiment of a spanner according to the invention and are by way of example.

DETAILED DESCRIPTION OF THE PREFERRED EMBODIMENTS

Figure 1:
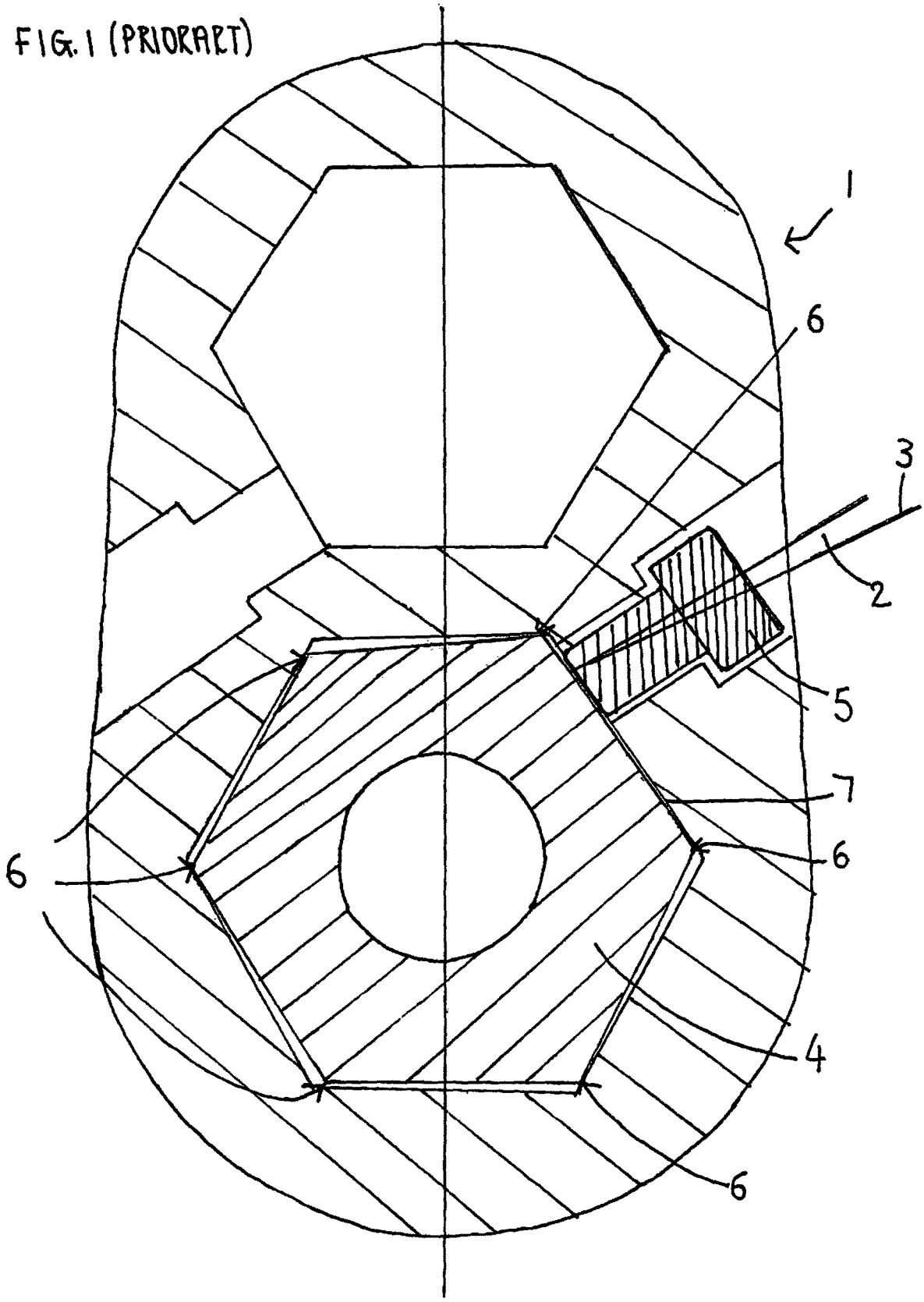
FIG. 1 (PRIOR ART)
FIG. 1 is a plan view of a prior art fastener holding spanner in an operating position on a nut.
Figure 2:
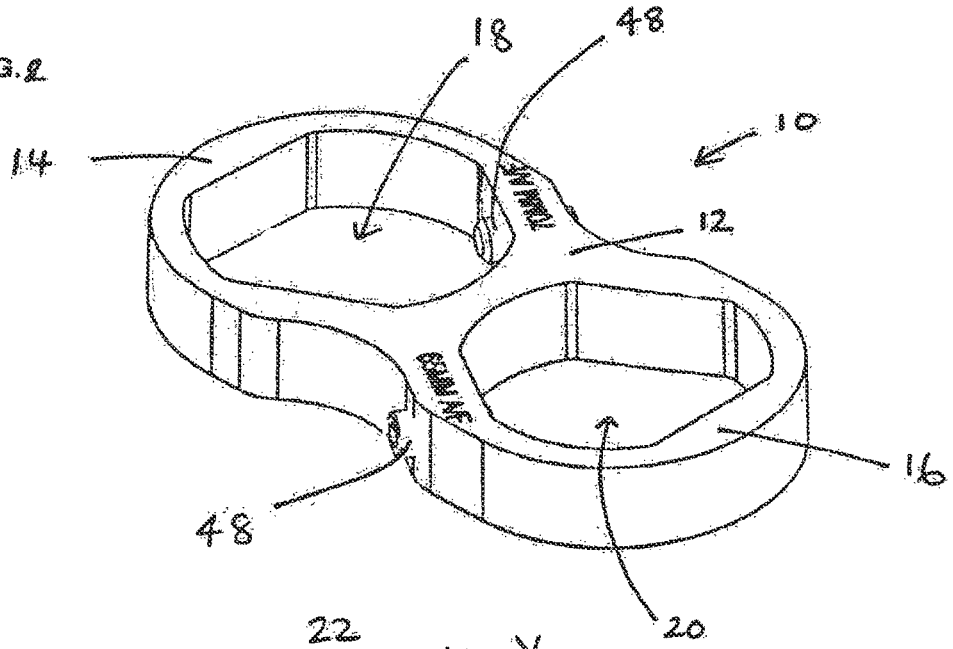
FIG. 2 is a perspective view of a fastener holding spanner according to the invention, the spanner including two spanner heads.
Figure 3:
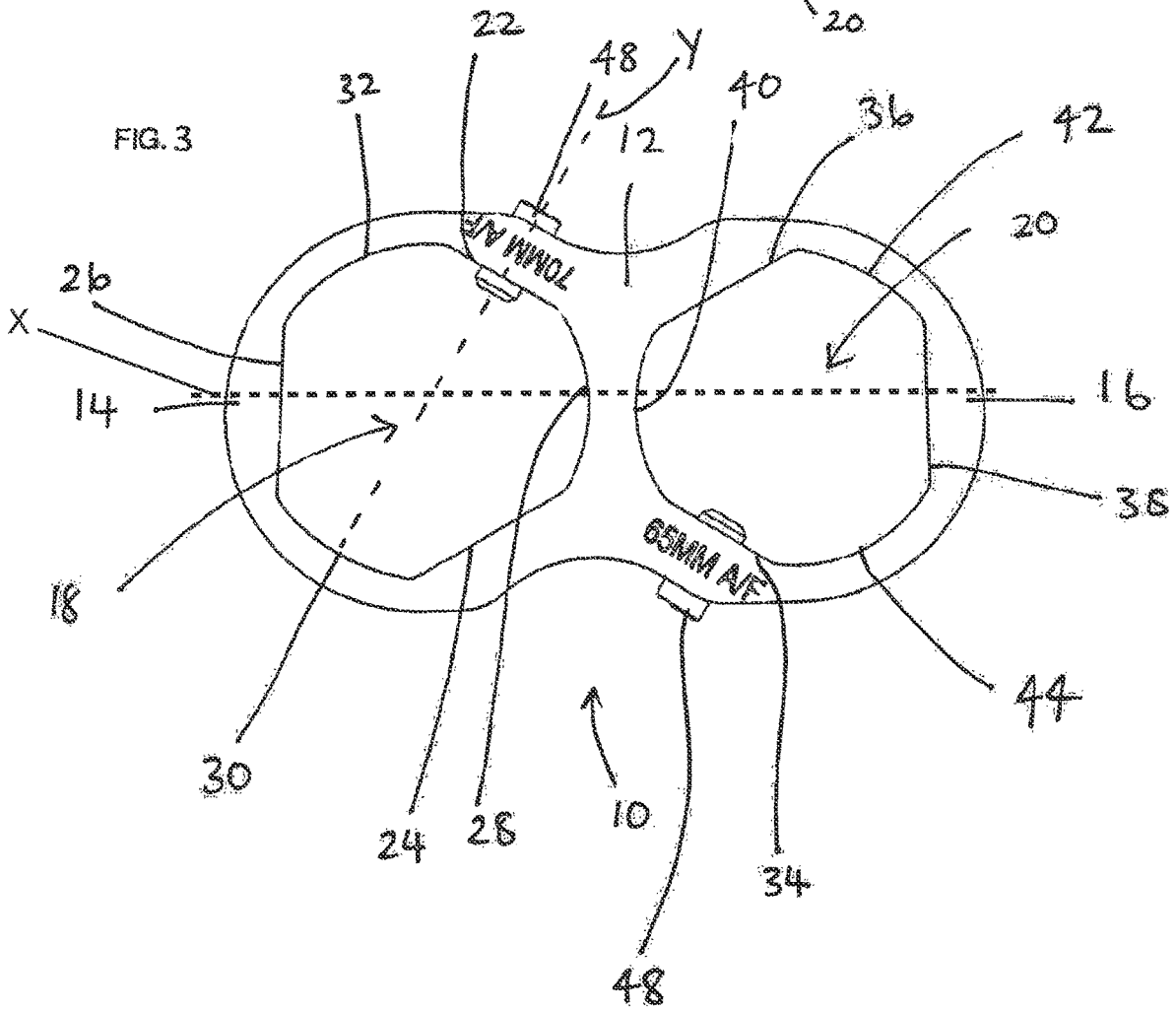
FIG. 3 is a plan view of the fastener holding spanner of FIG. 2.

FIGS. 2 and 3 illustrate a fastener holding spanner 10 in accordance with the invention. The spanner 10 has a unitary body 12 forming two spanner heads 14, 16 lying in a common plane and in each of which is provided an aperture 18, 20 for engaging with corresponding nuts or bolt heads when in use. In this example, the apertures 18, 20 are of different sizes to accommodate different nut or bolt head sizes using the one spanner 10. As will be apparent, it is common practice to provide a set of spanners 10 of varying sizes to accommodate a variety of nut and bolt head sizes commonly used. In this example each aperture 18, 20 comprises six internal faces (22, 24, 26, 28, 30, 32 and 34, 36, 38, 40, 42, 44).

As will become apparent from the following description, each spanner head 14, 16 functions as an arm for the other spanner head 14 16, each arm extending along a longitudinal arm axis X. In use of the spanner 10 the arm engages with an adjacent abutment surface.

Figure 4:
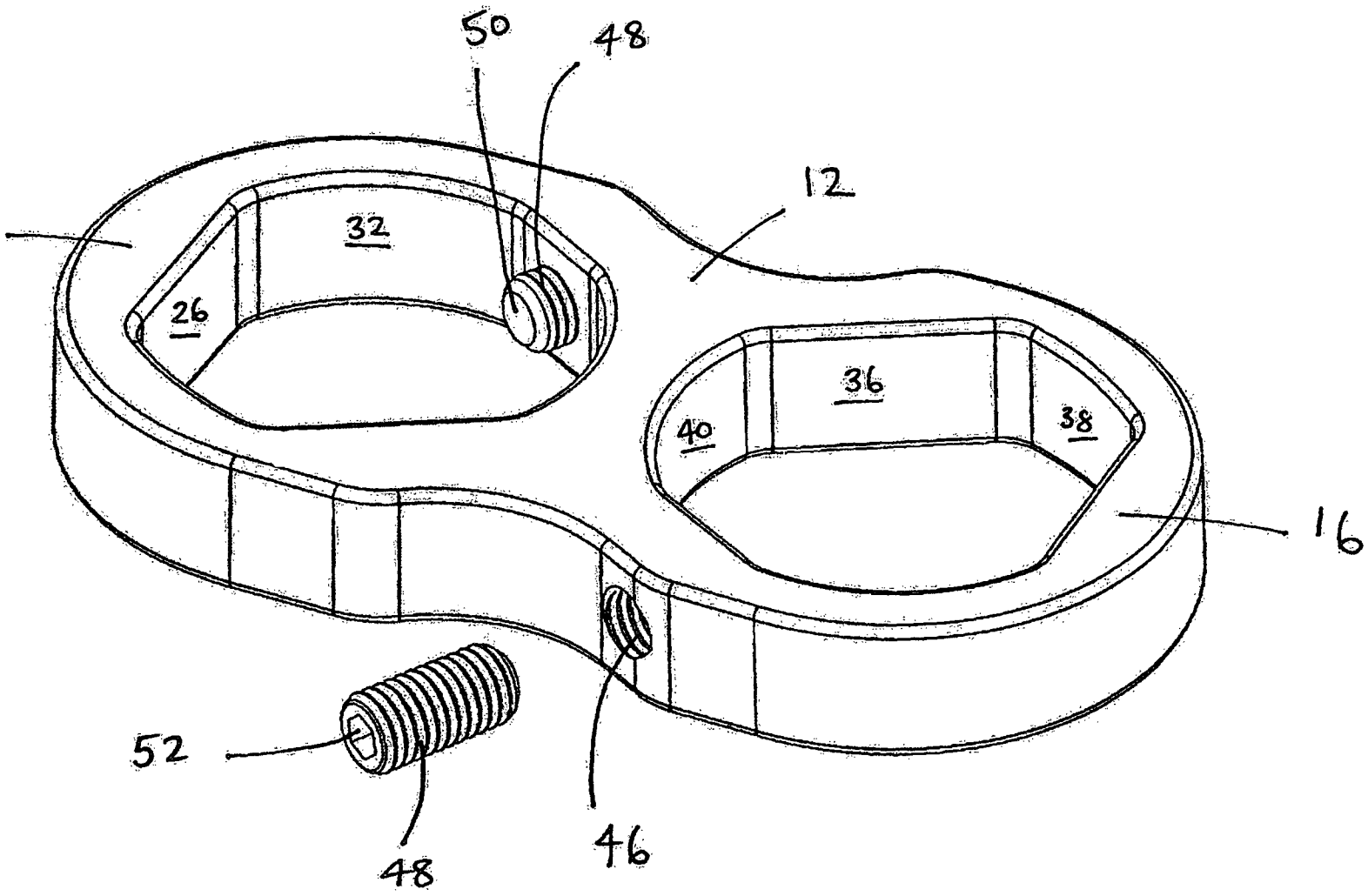
FIG. 4 is a perspective view of the fastener holding spanner of FIG. 2 with one of the grub screws removed.

As shown more clearly in FIG. 4, each spanner head 14, 16 is provided with a respective through passage 46 which penetrates a respective internal face 22, 34 of the apertures 18, 20. The passages 46 are each internally threaded. The longitudinal axis Y of each passage 46 is oriented substantially perpendicular to the flat internal face 22, 34 of the aperture 18, 20 which it penetrates.

Each through passage 46 is provided with a grub screw 48 typically of hardened steel. The end 50 of the grub screw 48 which engages the nut or bolt head is flat. The opposite end of the grub screw 48 is provided with a hexagonal aperture 52 by which it may be screwed into or out of its respective through passage 46.

Figure 5:
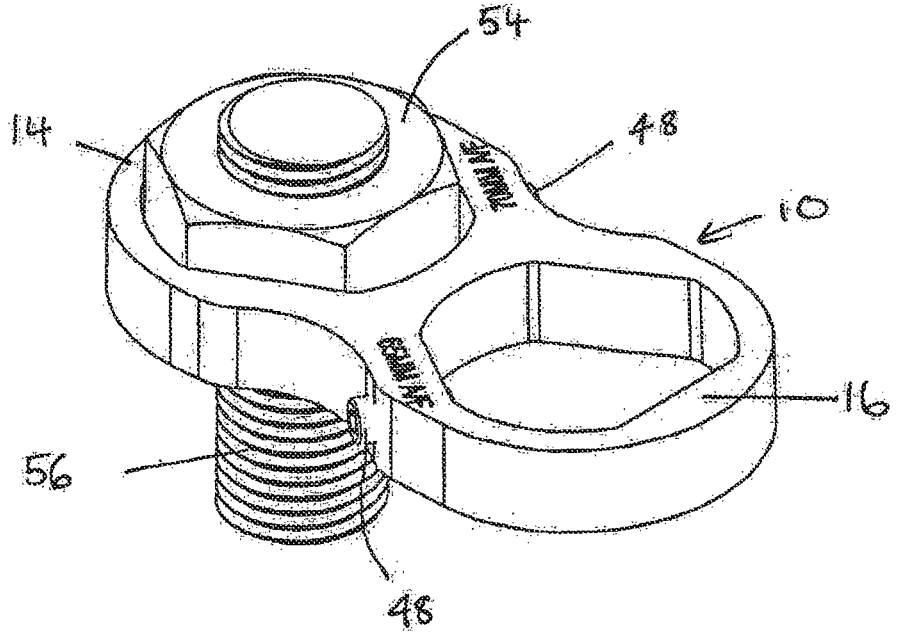
FIG. 5 is a perspective view of the fastener holding spanner of FIG. 21 located over a nut.
Figure 6:
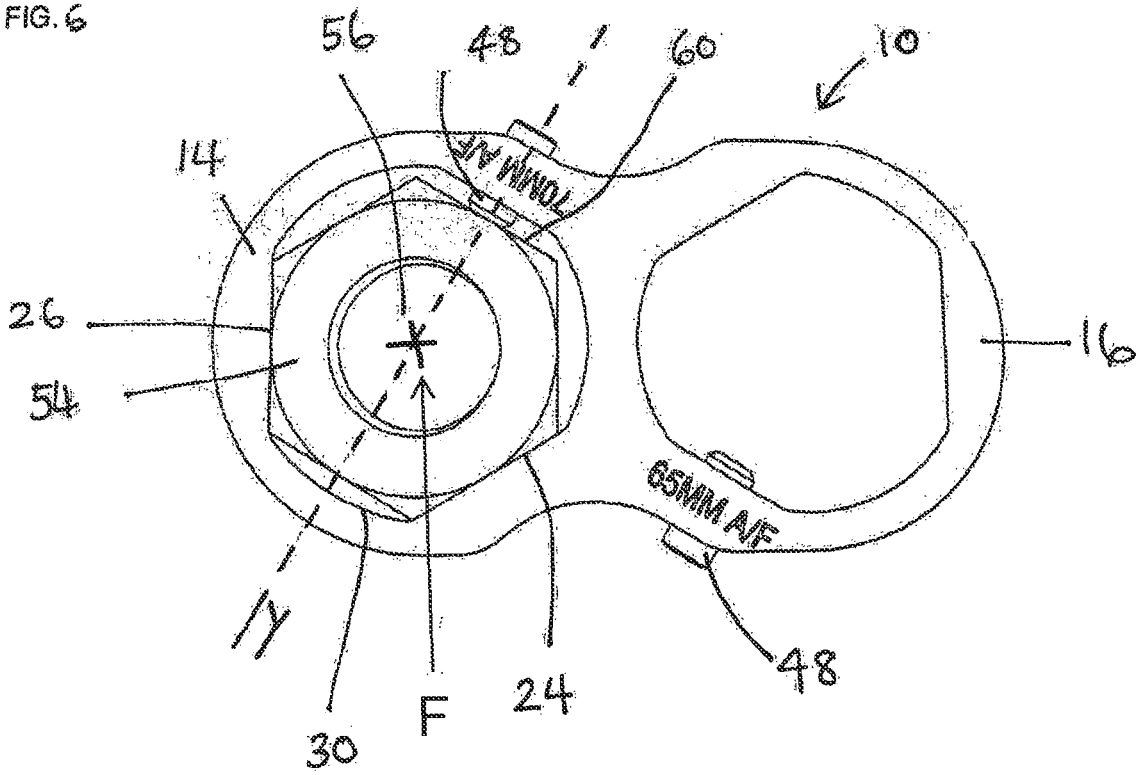
FIG. 6 is a plan view of the combination of fastener holding spanner and nut of FIG. 5.

FIGS. 5 and 6 illustrate a spanner 10 with one of the spanner heads (in this case 14) located around a nut 54 located on a bolt 56. It can be seen in FIG. 6 that when the grub screw 48 is tightened against the nut 54 two sides of the nut 54 are pressed against two flat internal sides 26 and 24 of the aperture 18. This arrangement provides for firm engagement of the spanner 10 to the nut 54. The nut engaging faces 24 and 26 of the aperture 18 are located on opposite sides of the longitudinal axis Y of the through passage 46. The internal face 30 of the aperture located in-between the two nut engaging faces 24 and 26 does not engage with the nut 54. In this example, the non engaging face 30 is concave in shape.

The nut 54 may be tightened onto the bolt 56 by the use of an appropriate torque spanner or wrench (not shown). The fastener holding spanner 10 is used to prevent rotation of the nut 54 about a fastener axis F, whilst the bolt head (not shown) is rotated by the applied torque. Equally, the fastener holding spanner 10 may be applied to the bolt head (not shown) to prevent rotation of the bolt head about the fastener axis F, whilst the nut 54 is rotated about the bolt 56.

The figures illustrate a preferred configuration of the spanner apertures. The illustrated spanner 10 is for use with six sided nuts or bolt heads and each aperture 18, 20 comprises six internal faces, three of which are substantially flat (22, 24, 26, and 34, 36, 38) and three of which are concave (28, 30, 32, and 40, 42, 44). Each concave internal face (28, 30, 32, and 40, 42, 44) is located in-between two flat internal faces. The nut engaging internal faces 24, 26 and 36, 38 are located on the opposite side of the aperture with respect to the through passage 46 and are located on opposing sides of the longitudinal axis Y of the through passage 46. This configuration allows for easy application of the spanner 10 to the nut 54 since the dimensions of the aperture 18 do not exactly match the dimensions of the nut 54 and there is a degree of play between the two. This configuration also provides a firm grip of the spanner 10 on the nut 54 as two flat internal faces 24, 26 of the spanner aperture 18 are pressed firmly against two flat faces of the nut 54 when the grub screw 48 is tightened, distributing the load.

Figure 7:
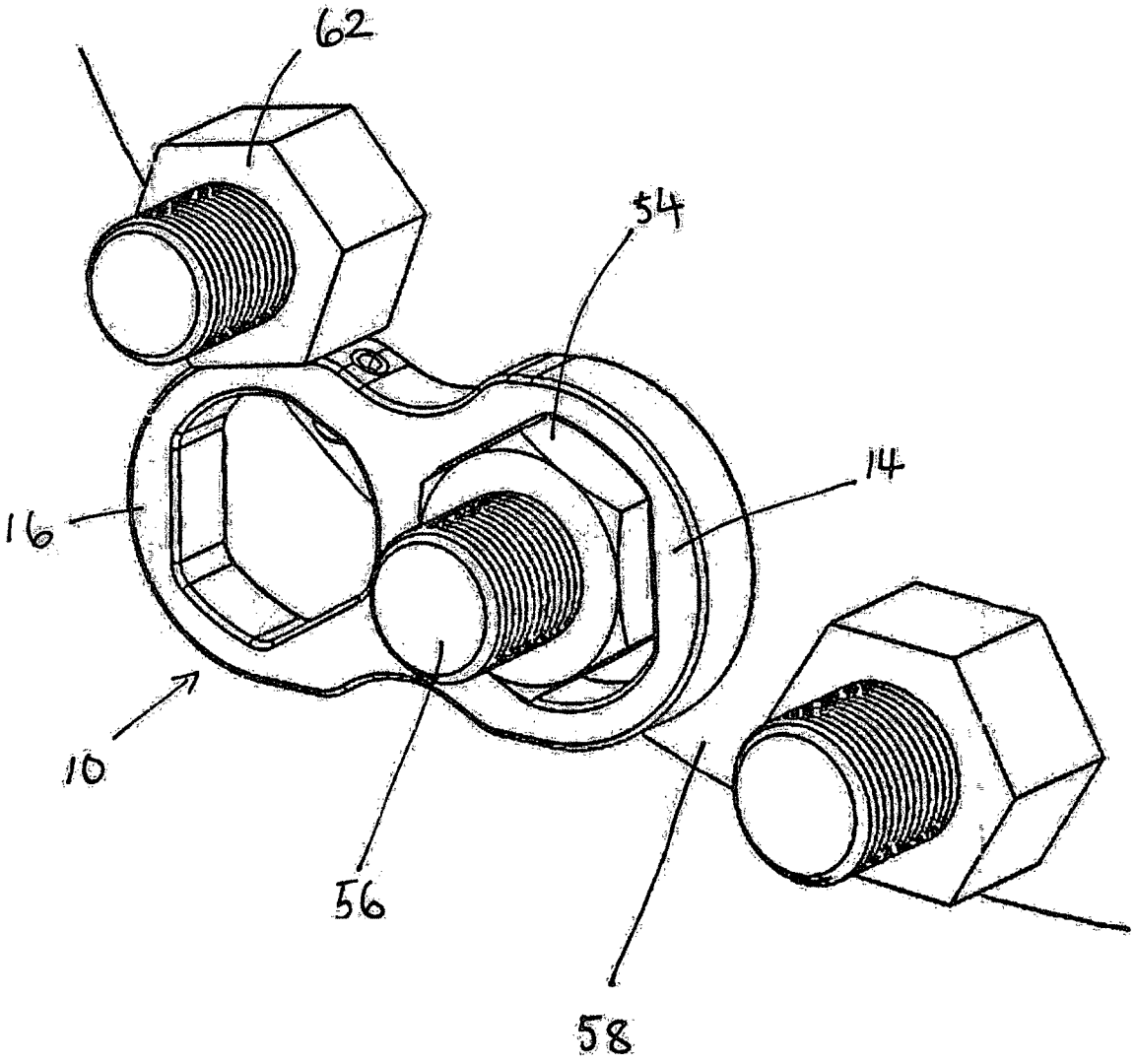
FIG. 7 is a partial view of a pipe flange showing the fastener holding spanner of FIG. 2 in an operating position on a nut on the flange.

FIG. 7 illustrates the fastener holding spanner 10 in an operating position on a nut 54 on a pipe flange 58. To tighten the fasteners to the required level, a torque spanner or wrench is used to tighten the bolt heads (not shown) in sequence to a preset torque. To prevent the nut 54 rotating under the application of the applied torque as it is applied to the respective bolt head, prior to the application of torque one spanner head 14, 16 (in this instance head 14) of the spanner 10 is located on the respective nut 54. The grub screw 48 is screwed into its through passage 46 to engage an opposed face 60 (see FIG. 6) of the nut 54 and to lock the spanner 10 relative to the nut 54. The flat end 50 of the grub screw 48 is consequently substantially fully in engagement with the face 60 of the nut 54.

As torque is applied to the opposed bolt head, the nut 54 onto which the spanner 10 is locked also rotates slightly until the spanner 10 contacts an adjacent nut 62 and is prevented from rotating further as shown in FIG. 7. This abutment of the spanner 10 on the adjacent nut 62 enables the torque applied to the opposed bolt head to rotate the bolt head relative to the nut 54 and enable it to be fully tightened to the required torque level. Once the bolt head is fully tightened, the grub screw 48 is unscrewed to release the locking effect thereof and enable the spanner 10 to be easily removed from the nut 54.

This procedure is repeated until all of the nuts on the pipe flange 58 have been tightened to the required torque level; and even, if necessary, on fasteners that have already been tightened to check the applied torque levels are correct.

To disassemble the pipe joint, the reverse procedure is used.

Figure 8:
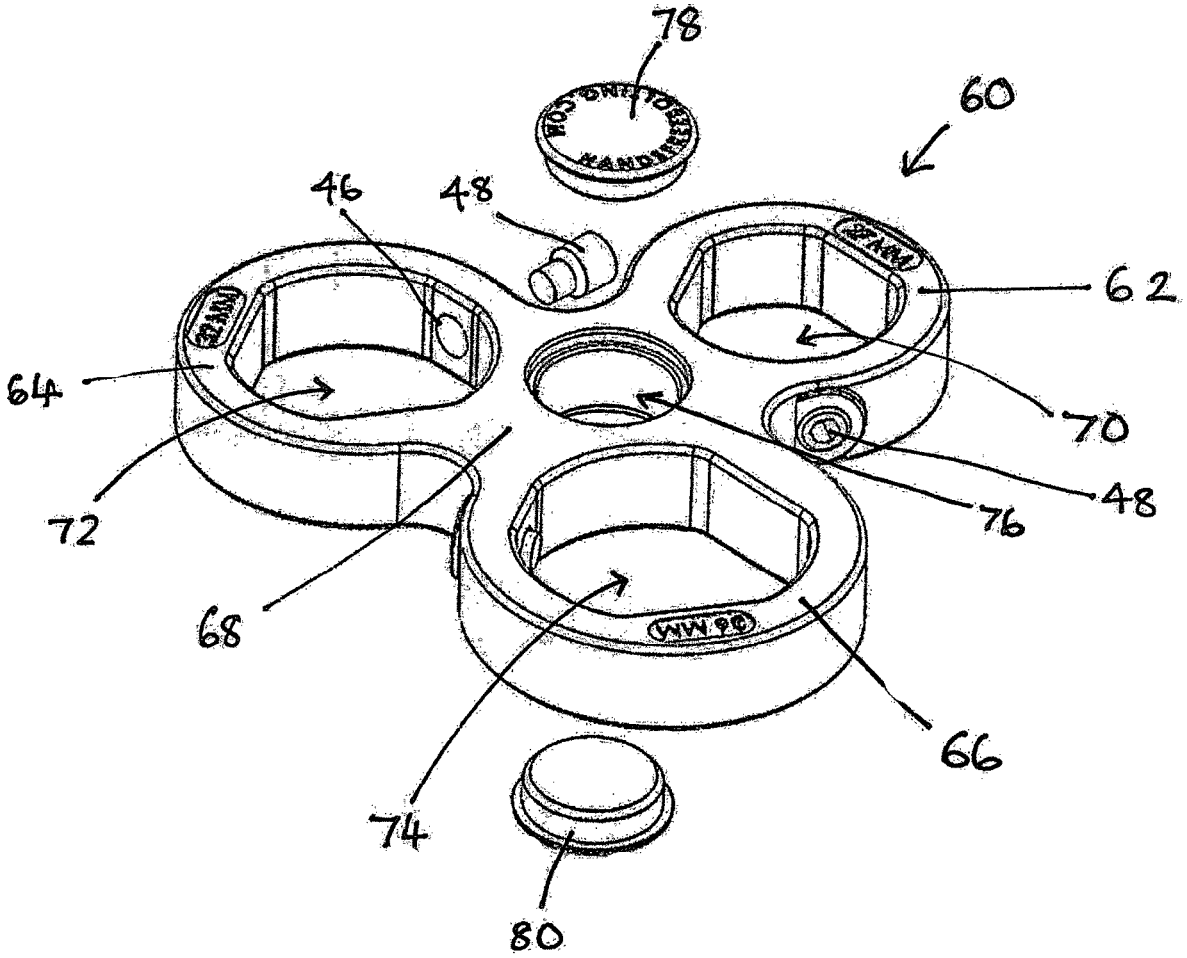
FIG. 8 is a perspective view of an alternative fastener holding spanner according to the invention, the spanner including three spanner heads.

FIG. 8 illustrates an example of a fastener holding spanner 60 in accordance with the invention which includes three spanner heads 62, 64, 66. The spanner 60 has a unitary body 68 forming the three spanner heads 62, 64, 66 lying in a common plane and each spanner head is provided an aperture 70, 72, 74 for engaging with corresponding nuts or bolt heads when in use. In this example, the apertures 70, 72, 74 are each a different size to accommodate different nut or bolt head sizes using the one spanner 60. The internal configuration of each aperture is identical to that described with reference to FIGS. 2-7. The centre of the spanner may include a hole 76 as shown in FIG. 8 which may or may not be coverable with end caps 78, 80. The presence of a hole 76 reduces the overall material volume required when casting the spanner 60 and may be used to for attachment of a safety lanyard or the like.

Figure 9:
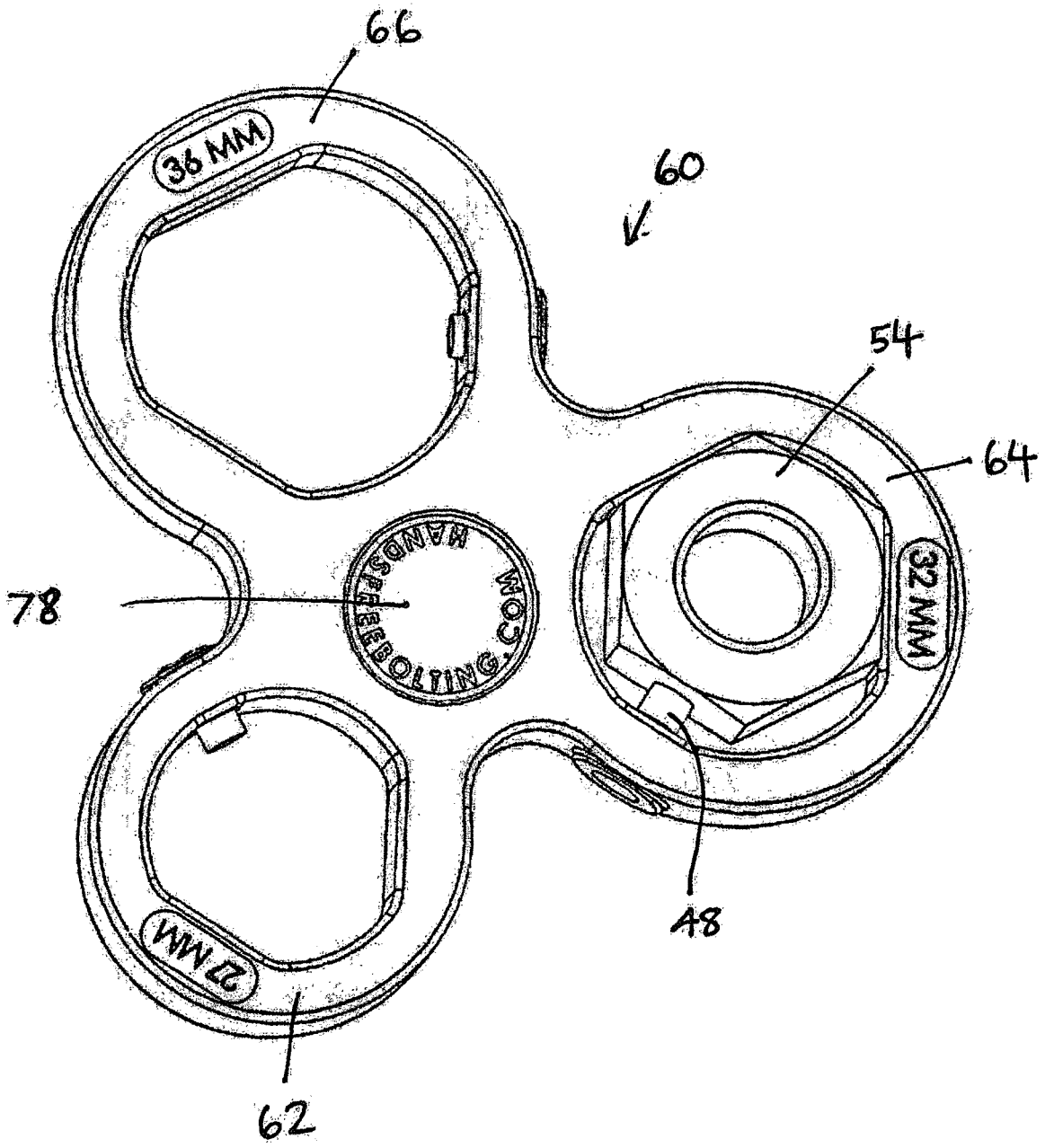
FIG. 9 is a plan view of the fastener holding spanner of FIG. 8 located over a nut.

FIG. 9 illustrates the fastener holding spanner 60 with one of the spanner heads 64 located around a nut 54. A grub screw 48 is tightened against the nut 54 and two sides of the nut 54 are pressed against two flat internal sides of the aperture 72 as previously described with reference to FIG. 6.

Figure 10:
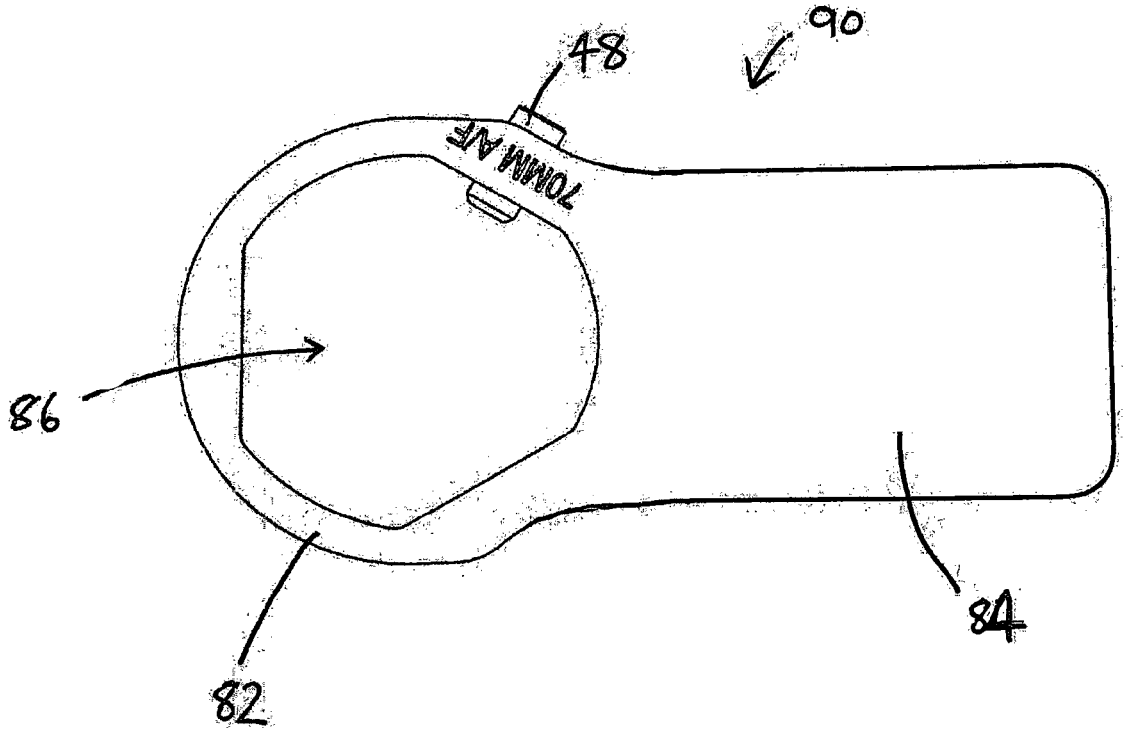
FIG. 10 is a plan view of an alternative fastener holding spanner according to the invention, the spanner including one spanner head.

Whilst in the preferred embodiments, a spanner 10 having two spanner heads 14 and 16, and a spanner 60 having three spanner heads 62, 64, 66, one of which in use functions as an arm to abut an adjacent abutment surface are described, it will be appreciated that, in an alternative embodiment, as illustrated in FIG. 10, the spanner may have an arm without an aperture therein depending from a single head of the spanner. The fastener holding spanner 90 illustrated FIG. 10 includes one spanner head 82 and one reaction arm 84 which lie in a common plane. The spanner head 82 has an aperture 86 for engaging with nuts or bolt heads when in use. The internal configuration of the aperture 86 is identical to that described with reference to FIGS. 2-7. In use the arm 84 would abut against the adjacent bolt head or nut upon rotation of the bolt or stud under applied torque.

Although in the described embodiments the abutment surfaces engaged by the arm of the spanner 10 constitutes a surface on an adjacent bolt head or nut of a fastener, it will be appreciated that in other configurations of components to be assembled together or disassembled, the abutment surface may be provided on a part of the components other than the fastener therefor.

As has been previously described, the aperture(s) of the fastener holding spanner according to the present invention preferably has an even number of faces and in the preferred embodiment as described with reference to the Figures has six faces corresponding to hexagonal fastener components in the form of nuts or bolt heads. Alternative configurations of aperture(s) are possible for use with different shaped nut or bolt heads.

The invention provides an improved fastener holding spanner which is both easily applied to a fastener and also maintains a firm grip on the fastener during use, and a spanner that may be easily cast rather than machined, due to the configuration of the internal faces of the aperture(s). This reduces manufacturing costs and also reduces the overall dimensions of the spanner.

The invention claimed is:

1. A fastener holding spanner comprising:

a first spanner head defining an aperture capable of engaging during use with a correspondingly-sized nut or bolt head of a fastener rotatable about a fastener axis, with a clearance therebetween, the aperture being defined by a plurality of internal faces including two engaging faces and a non-engaging face, each engaging face being substantially flat and arranged to engage with a flat face of the nut or bolt head engaged by the spanner during use, the non-engaging face being concave and located in between the two engaging faces, the first spanner head defining a through passage penetrating one of the plurality of internal faces opposite the non-engaging face, the through passage defining a longitudinal passage axis and being at least partially threaded over at least part of its length, the first spanner head including a threaded member configured to be screwed into the through passage, in use, an end of the threaded member contacting under pressure a face of the nut or bolt head engaged by the spanner to prevent relative rotation between the spanner and the nut or bolt head, the two engaging faces being distal from the threaded member and located on opposing sides of the longitudinal passage axis, the longitudinal passage axis intersects the fastener axis and the at least one non-engaging face; and an arm extending from the spanner head and having a longitudinal arm axis, the arm being configured to engage an abutment surface adjacent to the nut or bolt head of the fastener engaged by the first spanner head upon rotation of the nut or bolt head about the fastener axis under applied torque, the first spanner head and the arm lying in a common plane, the longitudinal passage axis being at an angle non-parallel to and non-perpendicular to the longitudinal arm axis, the arm of the spanner including a second spanner head integral with the first spanner head, the second spanner head being separated from the first spanner head by a narrow web portion.

2. A fastener holding spanner according to claim 1, wherein the longitudinal passage axis is oriented substantially perpendicular to the one of the plurality of internal faces while it penetrates.

3. A fastener holding spanner according to claim 1, wherein the aperture comprises an even number of internal faces and half of the internal faces are substantially flat and half of the internal faces are concave, each concave internal face being located in-between two flat internal faces.

4. A fastener holding spanner according to claim 3, wherein through passage penetrates a substantially flat internal face.

5. A fastener holding spanner according to claim 3, wherein the spanner is configured for use with a six sided nut or bolt head, and wherein the aperture comprises three flat internal faces and three concave internal faces, each concave internal face being located in-between two flat internal faces.

6. A fastener holding spanner according to claim 1, wherein the end of the threaded member which contacts a face of the nut or bolt head is flat.

7. A fastener holding spanner according to claim 1, wherein a longitudinal passage axis of the second spanner head is spaced part from and parallel to the longitudinal passage axis of the first spanner head.

8. A fastener holding spanner according to claim 1, wherein apertures in the two spanner heads are of different sizes.

9. A fastener holding spanner according to claim 1, comprising two arms, one arm providing the second spanner head and the other arm providing an additional spanner head integral with and having the same features as the first spanner head.

10. A fastener holding spanner according to claim 9, wherein the apertures in the three spanner heads are each of different sizes.

11. A fastener holding spanner according to claim 1, wherein the apertures of the first and second spanner heads are selected to provide a range of sizes suitable for use with common nut and bolt head sizes.

12. A fastener holding spanner according to claim 1, wherein the one of the plurality of internal faces penetrated by the through passage is spaced from the nut or bolt head when engaged by the spanner during use.

13. The fastener holding spanner according to claim 12, wherein the through passage penetrates a substantially flat internal face.

14. A fastener holding spanner according to claim 1, wherein each of the plurality of internal faces extends between a first end defined by an intersection with an internal face on a first side and a second end defined by an intersection with an internal face on an opposite, second side.

15. A fastener holding spanner according to claim 1, wherein the longitudinal passage axis halves the aperture.

* * * * *